US005698383A

United States Patent [19]

Pugh et al.

[11] Patent Number: 5,698,383

[45] Date of Patent: *Dec. 16, 1997

[54] COLOR PHOTOGRAPHIC ELEMENT WITH IMPROVED CONTRAST

[75] Inventors: Spencer Alan Pugh, Penfield; Sang Hyung Kim, Pittsford, both of N.Y.

[73] Assignee: Eastman Kodak Company, Rochester, N.Y.

[ * ] Notice: The term of this patent shall not extend beyond the expiration date of Pat. No. 5,691,124.

[21] Appl. No.: 580,266

[22] Filed: Dec. 28, 1995

Related U.S. Application Data

[60] Provisional application No. 60/003,822 Aug. 15, 1995.

[51] Int. Cl.[6] ..... G03C 1/46

[52] U.S. Cl. ..... 430/505; 430/506; 430/509; 430/543; 430/544; 430/551; 430/567; 430/379

[58] Field of Search ..... 430/505, 506, 430/509, 543, 544, 551, 567, 379

[56] References Cited

U.S. PATENT DOCUMENTS

| | | | |
|---|---|---|---|
| 4,237,214 | 12/1980 | Mifune et al. | 430/441 |
| 5,298,369 | 3/1994 | Munshi et al. | 430/379 |
| 5,378,591 | 1/1995 | Droin et al. | 430/506 |
| 5,391,469 | 2/1995 | Dickerson | 430/506 |
| 5,460,932 | 10/1995 | Chen et al. | 430/506 |
| 5,545,513 | 8/1996 | Edwards | 430/506 |
| 5,576,158 | 11/1996 | Ford et al. | 430/506 |

*Primary Examiner*—Geraldine Letscher

*Attorney, Agent, or Firm*—Sarah Meeks Roberts; Arthur H. Rosenstein

[57] ABSTRACT

This invention provides a color silver halide photographic element comprising a support having situated thereon a red light-sensitive, cyan dye-forming unit; a green light-sensitive, magenta dye-forming unit; and a blue light-sensitive, yellow dye-forming unit. The photographic element further comprising a first layer and a second layer, the second layer being a layer which provides a site of development for solution physical development.

23 Claims, No Drawings

COLOR PHOTOGRAPHIC ELEMENT WITH IMPROVED CONTRAST

CROSS REFERENCE TO RELATED APPLICATION

Reference is made to and priority claimed from U.S. Provisional Application Ser. No. 60/003,822, filed 15 Sep. 1995, entitled *Color Reversal Photographic Element.*

FIELD OF THE INVENTION

This invention relates to a color photographic element having a specific multilayer structure and comprising specific silver halide emulsions which provides improved contrast in the multilayer format. It more particularly relates to a reversal color photographic element.

BACKGROUND OF THE INVENTION

Good tone scale is important for an imaging system to have pleasing image rendition as further described in *Tone and Color Reproduction, The Theory of the Photographic Process,* fourth edition, edited by T. H. James, Macmillan Publishing Co., New York. Contrast is a measure used to characterize tone scale. It is generally calculated by taking two points on a sensitometric curve, one in the lower scale and one in the upper scale, and dividing the difference in density by the difference in log exposure. Of particular interest in film design is a contrast measure which compares the speed of the toe of the sensitometric curve to the speed of the midpoint of that curve. In this case the preferred contrast measurement is calculated by determining the exposure difference between the D=1.6 point and the D=0.3 point on the curve. The contrast is then calculated by dividing the density difference between these points, that is 1.3, by the exposure difference (in units of log exposure). The desired contrast of a photographic element depends upon the type of imaging material and its intended use.

Color silver halide imaging systems are designed with fast and slow emulsions combined to render pleasing tone scale. The emulsions are usually treated with spectral sensitizing dyes so that some are sensitive to blue light, some are sensitive to green light, and some are sensitive to red light. The emulsions can be coated in separate layers or blended and coated in the same layer, or any combination of these two approaches. Often, these emulsions are arranged into color records, so that in a color film there might be a blue light-sensitive color record, a green light-sensitive color record, and a red light-sensitive color record. Each record may consist of one or more emulsion-bearing layers.

In all of the systems containing combinations of emulsions of different speeds, pleasing tone scale can only be achieved by the careful and precise control of emulsion speeds. For example, if a combination of a fast and slow emulsion is being used, then the slow emulsion must be a specific amount slower than the fast emulsion. If it is slower than the desired amount, the resulting tone scale will be too low in contrast, and if it is faster than the desired amount, the resulting tone scale will be too high in contrast. Neither of these tone scale deficiencies is desirable.

Consequently, the relative speeds of the fast and slow emulsions are crucial for rendering a pleasing tone scale and images of high quality. Some variability in these relative speeds is inevitable due to variability in emulsion sizes and in film manufacturing and due to variability in film processing. This variability in speeds results in variability in contrast. The tolerance for the variability in contrast is dependent upon the usage of the imaging material, but it is approximately plus or minus 5% from manufacturing event to manufacturing event.

Managing the inevitable variability in emulsion size (and consequently speed) is critical to manufacturing photographic film that is pleasing to the customer. The customer prefers to have film that is of consistent performance, independent of manufacturing variability. In order to achieve this consistency, it is very desirable to have photographic film formulations that are robust. By robust, it is meant that the variability of the performance of the film is much less than the variability of the performance of the components (such as emulsions) that make up the film. The invention described herein is especially and surprisingly good at making film formulation robust.

For silver halide imaging systems of the type described above, the speed of the film is limited by the speed of the fast emulsions. At the same time, the quality of the final image structure (the graininess and sharpness) of the film is usually limited by the size of the fast emulsions. That is, faster emulsions are usually larger than slower emulsions and larger emulsions usually yield poorer image structure than slower emulsions.

In designing a film, one usually strives to meet a specific, practical speed while rendering as pleasing an image structure as possible at that speed. Consequently, one makes the fast emulsions as fast as needed to achieve that specific, practical speed, but no faster. Then, the sizes (and therefore speeds) of the slower emulsions are set so that they achieve pleasing tone scale when combined with these fast emulsions. Therefore, it is very critical to producing a film of a desired speed with good tone scale and optimum image structure, to be able to make slower emulsions of very specific speeds in the final multilayer film, which usually means making the slower emulsions of very specific sizes. However, (a film formulation) which requires such specific grain sizes is not very robust.

Compounding the problem of contrast control is that with the developers used for some film systems, most notably Process E-6 used with color reversal films, some of the coated emulsion develops by a process known as "solution physical development" (see *The Mechanism of Development* in *The Theory of the Photographic Process,* fourth edition, edited by T. H. James, Macmillan Publishing Co., New York). Solution physical development can have a large effect on emulsion speed, especially in the presence of a development accelerator, such as colloidal silver (also known as Carey Lea silver). Therefore, the task of providing a photographic element with good tone is even more complicated for emulsions undergoing such development. The effect of solution physical development is especially pronounced on slower emulsions.

Therefore, a need exists for a method of making the formulation of the photographic film more robust to variations in the grain size of the slow emulsions while still maintaining the preferred contrast.

SUMMARY OF THE INVENTION

This invention provides a color silver halide photographic element comprising a support having situated thereon a red light-sensitive, cyan dye-forming unit comprising a photosensitive silver halide emulsion layer and an image dye-forming coupler; a green light-sensitive, magenta dye-forming unit comprising a photosensitive silver halide emulsion layer and an image dye-forming coupler; and a blue light-sensitive, yellow dye-forming unit comprising a photosensitive silver halide emulsion layer and an image dye-forming coupler; the photographic element further comprising a first layer and a second layer, the second layer being a layer which provides a site of development for solution physical development; wherein at least one of the dye-forming units comprises two or more emulsion layers spectrally sensitized to the same region of the visible spectrum, but exhibiting different photographic sensitivities and wherein the first layer is positioned adjacent to the layer containing the slowest emulsion of said dye-forming unit and between the layer containing the slowest emulsion and the second layer; wherein in the layer containing the slowest emulsion of said dye-forming unit the slowest emulsion comprises tabular silver halide grains having a mean equivalent circular diameter of greater than 0.45 microns and wherein such grains account for at least 50% of the projected area of the grains in the emulsion layer when the layer contains a single emulsion and at least 25% of the projected area of the grains in the emulsion layer when the layer contains a blended emulsion.

Surprisingly, it has been found that a photographic element containing this first layer can be utilized with slow emulsions having a very broad range of grain sizes and still maintain the desired contrast. Without this interlayer, the desired film contrast can be achieved with only with a small range of emulsion sizes (a mean ECD less than 0.35 microns). Consequently, the addition of this layer increases the robustness of the formulation of a photographic element, resulting in more consistent product performance in the hands of customers.

There are other advantages to being able to use larger grains in the slow emulsion. These advantages vary with each application, but can include improved sharpness, improved color reproduction, and improved push processing performance. The additional interlayer provides the flexibility to use whatever grain size is needed to meet the specific needs of the photographic element being designed.

DETAILED DESCRIPTION OF THE INVENTION

Many photographic elements contain layers (herein called the second layer) which act as sites for solution physical development. These layers, intentionally or unintentionally, may accelerate the development of nearby silver halide image dye-forming layers. This can affect the desired contrast in such nearby layers. The inventors have discovered that certain interlayers (herein called the first layer) may act to modify such development acceleration. The use of the interlayer surprisingly allows for a greater range of silver halide grain size in the layers affected by the solution physical development. This combination of layer and grain size allows for a more robust formulation.

The color silver halide photographic elements of the invention can have any of the image forming or non-imaging forming layers known in the art. The photographic element is a multilayer, multicolor element. Most preferably it is reversal photographic element. The multicolor element contains dye image-forming units sensitive to each of the three primary regions of the visible light spectrum. Each unit may be comprised of a single emulsion layer, or of multiple emulsion layers spectrally sensitive to the same or substantially the same region of the spectrum. The layers of the element, can be arranged in various orders as known in the art.

In this invention the multicolor photographic element comprises, preferably in order from the support, a cyan dye image-forming unit comprising at least one red light-sensitive silver halide emulsion layer having associated therewith at least one cyan dye-forming coupler; a magenta image-forming unit comprising at least one green light-sensitive silver halide emulsion layer having associated therewith at least one magenta dye-forming coupler; and a yellow dye image-forming unit comprising at least one blue light-sensitive silver halide emulsion layer having associated therewith at least one yellow dye-forming coupler. In this invention the dye-forming unit of interest (i.e. the dye-forming unit for which one wants to modify the solution physical development effect caused by the second layer) comprises two or more emulsion layers spectrally sensitized to the same region of the visible spectrum, but exhibiting different photographic sensitivities. By photographic sensitivity, it is meant what is known in the art as photographic speed.

In this invention the first layer is adjacent to the layer containing the slowest emulsion of the dye-forming unit of interest and is between said slowest layer and the second layer which acts as the site for the solution physical development. There may be more than one layer which accelerates solution physical development in a photographic element (second layer) and the interlayer (first layer) of this invention may be utilized for each dye-forming unit which is affected by such a second layer.

As discussed, the dye-forming unit of interest comprises more than one silver halide emulsion layer. The tabular emulsions of the invention as described hereafter are located in the layer with the slowest emulsion of said dye-forming unit. Often a dye-forming unit containing multiple layers contains at least three silver halide emulsions of different photographic sensitivities. These are typically described as the fast emulsion, the mid emulsion and the slow emulsion. These emulsions can be coated separately in different layers or they can be blended and coated in the same layer, or any combination thereof. A two layer dye-forming unit might contain, for example, one layer containing only a fast emulsion and another layer containing both a mid emulsion and a slow emulsion. Other combinations of emulsions are also possible and are within the scope of this invention. Dye-forming units can also contain more than three silver halide emulsions. Regardless of the details of the composition of the layers, the layer with the slowest emulsion is adjacent to the first layer.

In one embodiment of the invention the dye-forming unit of interest comprising two or more emulsion layers in the blue light-sensitive, yellow dye-forming unit; and the first and second layers are positioned between the blue light-sensitive, yellow dye-forming unit and the green light-sensitive, magenta dye-forming unit. In another embodiment the hereafter described tabular emulsions are contained in the layer containing the slowest emulsion of the blue light-sensitive layers.

The first layer can be any hydrophilic colloidal layer known in the art. It may therefore comprise gelatin (e.g. ossein) or gelatin derivatives. Other specific suitable hydrophilic colloid materials which can be used alone or in combination include cellulose derivatives, polysaccharides such as dextran, gum arabic and the like; synthetic polymeric substances such as water soluble polyvinyl compounds like poly(vinylpyrrolidone), acrylamide polymers and the like. Other materials are described in U.S. Pat. No. 5,298,369 and *Research Disclosure* December 1989 Item 308119, par. IXA, which are incorporated herein by reference.

The first layer must modify the effect of the accelerated development of the dye-forming unit of interest caused by the solution physical development. The first layer typically is coated at levels between 260 and 2200 mg gelatin/$m^2$; and preferably at levels between 500 and 1000 mg gelatin/$m^2$. The first layer may contain additional additives such as thickening agents, surfactants, hardeners, couplers, oxidized developing agent scavengers, development inhibitors, development accelerators, absorbing dyes, and the like. These compounds may be added in amounts and by methods known in the art. The first layer typically will not contain colloidal silver.

The first layer preferably comprises an oxidized developing agent scavenger. Exemplary scavengers include disulfoamidophenols and the ballasted or otherwise non-diffusing antioxidants illustrated in U.S. Pat. Nos. 2,336,327; 2,728,659; and 2,403,721, all of which are incorporated herein by reference. Others are described in *Research Disclosure* December 1989 Item 308119, par. VII.I, and *Research Disclosure,* September 1994, Item 36544, par X.D which are incorporated herein by reference. It is preferred that the scavenger be incorporated into the layer in an amount from 10–1,000 mg/$m^2$; preferably an amount from 50–200 mg/$m^2$; and optimally an amount from 75–125 mg/$m^2$.

The second layer is any layer which acts as a site for solution physical development (see *The Mechanism of Development* in *The Theory of the Photographic Process,* fourth edition, edited by T. H. James, Macmillan Publishing Co., New York). The second layer can also be selected from those layers known in the art. Examples of such layers include, but are not limited to, layers comprised of fogged silver halide grains or colloidal silver layers. In a colloidal silver layer the colloidal silver may be any colloidal elemental silver of the types commonly employed in the photographic arts. For example, it may be yellow colloidal silver, i.e., Carey Lea silver, or black or, gray/black colloidal silver. In general, such silver colloids contain silver particles having a size within the range from about 50 to about 100 angstroms. The silver colloids are generally formed in gelatin or other hydrophilic colloids of the type described above. For example, Carey Lea silver is generally prepared by a process comprising silver reduction in a basic solution obtained by reacting dextrin and silver nitrate. In many instances, phthlated gelatin is added to facilitate washing of the silver product.

The level of colloidal silver may differ depending on the purpose of the layer. Typically the level of colloidal silver will be in the range of from 5 to 500 mg/$m^2$. More typically, it will be in the range of from 25 to 250 mg/$m^2$, and usually, it will be in the range of from 50 to 150 mg/$m^2$.

Often a colloidal silver layer is utilized as a yellow filter layer and appropriate levels of silver will be utilized for that purpose. Alternatively, a layer containing yellow filter dye may be used. Suitable dyes include those described in U.S. Pat. Nos. 2,538,008; 2,538,009; 4,420,555; 4,950,586; 4,948,718; 4,948,717; 4,940,654; 4,923,788; 4,900,653; 4,861,700; 4,857,446; 4,855,221, 5,213,956, 5,213,957 and 5,298,377; U.K. Patents 695,873 and 760,739; European Patent Application 430,186; and Provisional Application Ser. No. 60/001,801 entitled "Photographic Element Comprising A Novel Filter Dye" filed Jul. 27, 1995. In that case the second layer may comprise fogged grains instead of colloidal silver. The yellow filter dye may be in the second layer or in a separate layer. A yellow filter dye may also be included in the colloidal silver layer.

Other additives may be added to the second layer. They can be any of the additives described above for addition to the first layer. The compounds may be added in amounts and by methods known in the art.

The element may contain layers in addition to those described above. Such layers include filter layers, interlayers, overcoat layers, subbing layers, and the like. The photographic elements may also contain a transparent magnetic recording layer such as a layer containing magnetic particles on the underside of a transparent support, as described in *Research Disclosure,* November 1992, Item 34390 published by Kenneth Mason Publications, Ltd., Dudley Annex, 12a North Street, Emsworth, Hampshire PO10 7DQ, ENGLAND. Typically, the element will have a total thickness (excluding the support) of from about 5 to about 30 microns. Further, the photographic elements may have an annealed polyethylene naphthalate film base such as described in Hatsumei Kyoukai Koukai Gihou No. 94-6023, published Mar. 15, 1994 (Patent Office of Japan and Library of Congress of Japan) and may be utilized in a small format system, such as described in *Research Disclosure,* June 1994, Item 36230 published by Kenneth Mason Publications, Ltd., Dudley Annex, 12a North Street, Emsworth, Hampshire PO10 7DQ, ENGLAND, and such as the Advanced Photo System, particularly the Kodak ADVANTIX films or cameras.

In the photographic elements of this invention the layer containing the slowest emulsion of the dye-forming unit of interest comprises tabular silver halide grains meeting specific parameters. The slowest emulsion in said layer will comprise silver halide grains with a mean equivalent circular diameter greater than 0.45 microns. While no upper limit is specifically required, those skilled in the art will realize that the grain size must be limited to one that is practical for use in an emulsion and which gives the desired speed characteristics. Normally, the silver halide grains will not have a mean equivalent circular diameter greater than 1.5 microns. If there is only one emulsion in the layer that emulsion is the, slowest emulsion as defined above. Preferably, such tabular grains have a mean Tabularity (Tabularity being defined as a grain's equivalent circular diameter in microns divided by the square of its thickness) greater than 10, and more preferably greater than about 25.

When silver halide grains of only one emulsion type are in the silver halide emulsion layer containing the slowest emulsion it is contemplated that the tabular grains of the invention have the specified mean equivalent circular diameter and account for at least about 50% of the projected area of grains in the particular emulsion layer. More preferably, they account for at least 75% of the projected area; and optimally, they account for at least 90% of the projected area. If the tabular emulsion is combined or blended with an emulsion of another speed to form, for example, a slow-mid layer, the preferred tabular grains donated by the slowest emulsion may account for about 25% to 75% of the projected area of grains in the particular emulsion layer, more preferably closer to 50%. The preferred tabular grains donated by the slowest emulsion should account for at least 25%, and preferably at least 40%, of the projected area of grains in the particular emulsion layer when the layer contains a blended emulsion.

The emulsions used in any layer can be either monodisperse or polydisperse as precipitated. The grain size distribution of the emulsion can be controlled by silver halide grain separation techniques or by blending silver halide emulsions of differing grain sizes.

The grains utilized in the silver halide photographic elements may be comprised of silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. In accordance with the invention, it is preferred that the grains in each of the dye-forming units contain at least 75% and more preferably at least 90% silver bromoiodide. Optimally they are entirely silver bromoiodide. The iodide content in such emulsions is preferably from 1 to 15 mole percent, preferably 2 to 6 mole percent, and optimally 2 to 4 mole percent.

The silver halide emulsions employed in the other dye-forming layers and/or units of the invention can contain grains of any size and morphology. The grains may take the form of cubes, octahedrons, cubo-octahedrons, or any of the other naturally occurring morphologies of cubic lattice type silver halide grains. Further, the grains may be irregular such as spherical grains or tabular grains. Particularly preferred are grains having a tabular morphology, and more preferred are those having a mean Tabularity greater than 10, and more preferably a mean Tabularity greater than about 25.

The silver halide grains can be contained in any conventional dispersing medium capable of being used in photographic emulsions. Specifically, it is contemplated that the dispersing medium be an aqueous gelatino-peptizer dispersing medium, of which gelatin—e.g., alkali treated gelatin (cattle bone and hide gelatin)—or acid treated gelatin (pigskin gelatin) and gelatin derivatives—e.g., acetylated gelatin, phthalated gelatin—are specifically contemplated. When used, gelatin is preferably at levels of 0.01 to 100 grams per total silver mole. Also contemplated are dispersing mediums comprised of synthetic colloids.

Silver halide color reversal films are typically associated with an indication for processing by a color reversal process. Reference to a film being associated with an indication for processing by a color reversal process most typically means the film, its container, or packaging (which includes printed inserts provided with the film), will have an indication on it that the film should be processed by a color reversal process. The indication may, for example, be simply a printed statement stating that the film is a "reversal film" or that it should be processed by a color reversal process, or simply a reference to a known color reversal process such as "Process E-6". A "color reversal" process in this context is one employing treatment with a non-chromogenic developer (that is, a developer which will not imagewise produce color by reaction with other compounds in the film; sometimes referenced as a "black and white developer"). This is followed by fogging unexposed silver halide, usually either chemically or by exposure to light. Then the element is treated with a color developer (that is, a developer which will produce color in an imagewise manner upon reaction with other compounds in the film).

In a typical construction, a reversal film does not have any masking couplers. Furthermore, reversal films have a gamma generally between 1.5 and 2.0, a gamma which is much higher than the gamma for typical negative materials.

In the following Table, reference will be made to (1) *Research Disclosure,* December 1978, Item 17643, (2) *Research Disclosure,* December 1989, Item 308119, (3) *Research Disclosure,* September 1994, Item 36544, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the photographic element of the invention. The Table and its cited references also describe suitable ways of exposing, processing and manipulating the elements, and the images contained therein. Components which are particularly suitable for use in the photographic element of the invention are described in *Research Disclosure,* February 1995, Item 37038, published by Kenneth Mason Publications, Ltd., Dudley Annex, 12a North Street, Emsworth, Hampshire PO10 7DQ, ENGLAND, the disclosure of which is incorporated herein by reference.

| Reference | Section | Generic System Element(s) |
|---|---|---|
| 1 | I, II | Grain composition, |
| 2 | I, II, IX, X, XI, XII, XIV, XV | morphology and preparation; Emulsion preparation including hardeners, coating |
| 3 | I, II, III, IX A & B | aids, addenda, etc. |
| 1 | III, IV | Chemical sensitization and |
| 2 | III, IV | spectral sensitization/ |
| 3 | IV, V | desensitization |
| 1 | V | UV dyes, optical brighteners, |
| 2 | V | luminescent dyes |
| 3 | VI | |
| 1 | VI | Antifoggants and stabilizers |
| 2 | VI | |
| 3 | VII | |
| 1 | VIII | Absorbing and scattering |
| 2 | VIII, XIII, XVI | materials; Antistatic layers; matting agents |
| 3 | VIII, IX C & D | |
| 1 | VII | Image-couplers and image- |
| 2 | VII | modifying couplers; Dye |
| 3 | X | stabilizers and hue modifiers |
| 1 | XVII | Supports |
| 2 | XVII | |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

Supports for photographic elements of the present invention include polymeric films such as cellulose esters (for example, cellulose triacetate and diacetate) and polyesters of dibasic aromatic carboxylic acids with divalent alcohols (for example, poly(ethylene-terephthalate), poly(ethylene-napthalates)), paper and polymer coated paper. Such supports are described in further detail in *Research Disclosure* 3, Section XV.

The photographic elements may also contain additional materials that accelerate or otherwise modify the processing steps of bleaching or fixing to improve the quality of the image. Bleach accelerators described in European Patent Applications 193,389 and 301,477; U.S. Pat. Nos. 4,163,669; 4,865,956; and 4,923,784 are particularly useful. Also contemplated is the use of nucleating agents, development accelerators or their precursors (UK Patents 2,097,140 and 2,131,188); electron transfer agents (U.S. Pat. Nos. 4,859,578 and 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes, either as oil-in-water dispersions, latex dispersions or as solid particle dispersions. Additionally, they may be used with "smearing" couplers (e.g. as described in U.S. Pat. Nos.

4,366,237; 4,420,556; 4,543,323 and European Patent Application 96,570.) Also, the couplers may be blocked or coated in protected form as described, for example, in Japanese Application 61/258,249 or U.S. Pat. No. 5,019,492.

The photographic elements may further contain other image-modifying compounds such as "Developer Inhibitor-Releasing" compounds (DIR's). DIR compounds are disclosed, for example, in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. DIRs that have particular application in color reversal elements are disclosed in U.S. Pat. Nos. 5,399,465; 5,380,633; 5,399,466; and 5,310,642.

It is also contemplated that the concepts of the present invention may be employed to obtain reflection color prints. The emulsions and materials to form elements of the present invention, may be coated on a pH adjusted support as described in U.S. Pat. No. 4,917,994; with epoxy solvents (European Patent Application 0 164 961); with additional stabilizers (as described, for example, in U.S. Pat. Nos. 4,346,165; 4,540,653; and 4,906,559); with ballasted chelating agents such as those in U.S. Pat. No. 4,994,359 to reduce sensitivity to polyvalent cations such as calcium; and with stain reducing compounds such as described in U.S. Pat. Nos. 5,068,171 and 5,096,805. Other compounds useful in the elements of the invention are disclosed in Japanese Published Applications 83-09,959; 83-62,586; 90-072,629; 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide grains to be used in the invention may be prepared according to methods known in the art, such as those described in *Research Disclosure* 3 and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure* 3 and the references cited therein.

The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30° to 80° C., as illustrated in *Research Disclosure*, June 1975, item 13452 and U.S. Pat. No. 3,772,031.

The silver halide may be sensitized by sensitizing dyes by any method known in the art, such as described in *Research Disclosure* 3. Examples of dyes include dyes from a variety of classes, including the polymethine dye class, which includes the cyanines, merocyanines, complex cyanines and merocyanines (i.e., tri-tetra-, and polynuclear cyanines and merocyanines), oxonols, hemioxonols, stryryls, merostyryls, and streptocyanines. The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating.

Photographic elements of the present invention can be imagewise exposed using any of the known techniques, including those described in *Research Disclosure* 3. This typically involves exposure to light in the visible region of the spectrum, and typically such exposure is of a live image through a lens. However, the photographic elements of the present invention may be exposed in a film writer as described above. Exposure in a film writer is an exposure to a stored image (such as a computer stored image) by means of light emitting devices (such as light controlled by light valves, CRT and the like).

The photographic elements of this invention are most suitable for use with processing systems which depend in part on solution physical development, or in which such development may unintentionally take place. The Process E-6 black-and-white developer is notable in this aspect, having a high level of silver ion chelating agents, known colloquially as silver halide solvents. Preferably the photographic elements comprising the composition of the invention are color reversal elements. These may be processed in any color reversal process. Such processes, as described above, require first treating the element with a black and white developer, followed by fogging non-exposed grains using chemical or light fogging, followed by treatment with a color developer.

Preferred non-chromogenic developers (that is, black and white developers) are hydroquinones (such as hydroquinone sulphonate).

Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(b-(methanesulfonamido) ethylaniline sesquisulfate hydrate, 4-amino-3-methyl-N-ethyl-N-(b-hydroxyethyl)aniline sulfate, 4-amino-3-b-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying. Bleaching and fixing can be performed with any of the materials known to be used for that purpose. Bleach baths generally comprise an aqueous solution of an oxidizing agent such as water soluble salts and complexes of iron (III) (e.g., potassium ferricyanide, ferric chloride, ammonium or potassium salts of ferric ethylenediaminetetraacetic acid), water-soluble persulfates (e.g., potassium, sodium, or ammonium persulfate), water-soluble dichromates (e.g., potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like. Further details of bleach and fixing baths can be found in *Research Disclosure* 3.

The photographic elements can be incorporated into exposure structures intended for repeated use or exposure structures intended for limited use, variously referred to as single use cameras, lens with film, or photosensitive material package units. The color reversal elements of the present invention can also be used by exposing them in an electronic film writer (such film writers typically expose the film by laser, laser diode, or some other controlled light source).

The practice of the invention is described in detail below with reference to specific illustrative examples, but the invention is not to be construed as being limited thereto.

EXAMPLES

This example demonstrates that in a photographic element without the first layer of the invention between a colloidal silver containing layer (the second layer of the invention) and the blue light-sensitive, yellow dye-forming layer, the slowest tabular emulsions in the slow blue light-sensitive layer must have a mean equivalent circular diameter of less than 0.35 microns in order to achieve the desired contrast range. It further shows that a photographic element having the first layer between the colloidal silver containing layer and the blue light-sensitive yellow dye-forming layer can have a blue light-sensitive layer wherein the slowest tabular grains can have a mean equivalent circular diameter greater than 0.45 microns and still meet the desired contrast range. The sample elements were prepared by conventional methods. Samples 1 through 11 were multilayer color reversal photographic elements having the following layer structure:

Support
Layer 1: Antihalation Layer
Layer 2: First Interlayer
Layer 3: First Red light-sensitive Layer (slow)
Layer 4: Second Red light-sensitive Layer (mid)
Layer 5: Third Red light-sensitive Layer (fast)
Layer 6: Second Interlayer
Layer 7: Third Interlayer
Layer 8: First Green light-sensitive Layer (slow)
Layer 9: Second Green light-sensitive Layer (mid)
Layer 10: Third Green light-sensitive Layer (fast)
Layer 11: Fourth Interlayer
Layer 12: Fifth Interlayer
Layer 13: Sixth Interlayer
Layer 14: First Blue light-sensitive Layer (slow)
Layer 15: Second Blue light-sensitive Layer (fast)
Layer 16: First Overcoat Layer.
Layer 17: Second Overcoat Layer.

Each of the layers was prepared by conventional methods and contained conventional couplers. The 12th layer represented the second layer of the invention. It contained colloidal silver, specifically in an amount equal to 75 mg/m$^2$. It also contained 680 mg/m$^2$ gelatin, a surfactant, a polymeric thickening agent, and a hardener. Layer 13 represented the invention's first layer. It contained gelatin at a level of 650 mg/m$^2$ gelatin, a thickening agent (copolymer of: acrylamide (20%) and 2-acrylamide-2-methyl propane sulphonic acid (80%)), and an oxidized developing agent scavenger of the structure:

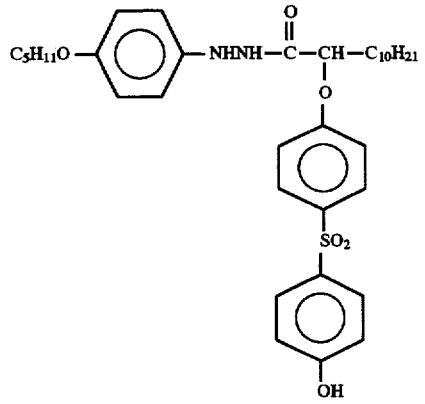

Layer 14, the slow blue light-sensitive emulsion layer of the blue light-sensitive, yellow dye-forming unit contained a catechol sequestering agent, antifoggant, a yellow dye-forming coupler and a release compound capable of providing delayed release of a development inhibitor moiety. The silver bromoiodide grains of the slowest emulsion (ranging from three to four mole percent iodide) in this emulsion layer were formed by precipitation in the presence of potassium iridium hexachloride. The grains were tabular grains having a mean equivalent circular diameter as described in Table 1 which follows. All of the slowest emulsions of the slow blue light-sensitive emulsion layer had a mean Tabularity greater than 30. The slowest emulsion in this layer accounted for 46% of the projected area of the grains in the emulsion layer. The grains were chemically and spectrally sensitized by methods known in the art. Layer 14 was a blended layer also containing a mid-yellow emulsion of 3% iodide tabular silver bromoiodide grains. The grains of the mid emulsion were 1.0 microns×0.13 microns with a mean tabularity of 59. It is contemplated that a mid-yellow emulsion having a mean ECD greater than 0.85 microns and less than 1.5 microns would be suitable in this embodiment. It is further contemplated that iodide levels of 2 to 6% would be suitable in this embodiment.

Layer 15 contained a fast-yellow emulsion of 2% iodide tabular silver bromoiodide grains. The grains were 2.0 microns×0.15 microns with a mean Tabularity of 89. It is contemplated that a fast-yellow emulsion having a mean ECD greater than 1.5 microns and less than 2.5 microns would be suitable in this embodiment. It is contemplated that iodide levels of 2 to 6% would be suitable in this embodiment.

Samples 16 through 26 were prepared as described for Samples 1 through 11 except that there was no first layer of the invention between the colloidal silver containing layer (the second layer of the invention) and the blue light-sensitive, yellow dye-forming layer; rather the layer containing colloidal silver was adjacent the blue light-sensitive, yellow dye-forming unit.

Samples 16 through 26 have the following layer structure:

Support
Layer 1: Antihalation Layer
Layer 2: First Interlayer
Layer 3: First Red light-sensitive Layer (slow)
Layer 4: Second Red light-sensitive Layer (mid)
Layer 5: Third Red light-sensitive Layer (fast)
Layer 6: Second Interlayer
Layer 7: Third Interlayer
Layer 8: First Green light-sensitive Layer (slow)
Layer 9: Second Green light-sensitive Layer (mid)

Layer 10: Third Green light-sensitive Layer (fast)
Layer 11: Fourth Interlayer
Layer 12: Fifth Interlayer
Layer 13: First Blue light-sensitive Layer (slow)
Layer 14: Second Blue light-sensitive Layer (fast)
Layer 15: First Overcoat Layer.
Layer 16: Second Overcoat Layer.

The 12th layer is the colloidal silver layer and layer 13 is the slow blue light-sensitive emulsion layer of the blue light-sensitive, yellow dye-forming unit. The slowest silver halide emulsions in this emulsion layer compristed tabular grains having a mean equivalent circular diameter as described in Table 1. All of the slowest emulsions of the slow blue light-sensitive emulsion layer had a mean Tabularity greater than 30. The mid and fast emulsions used in these samples were the same as used in Samples 1 to 11 and layer 13 was again a blended layer.

The samples were given a stepped exposure on a Type 1-b sensitometer having 5500K color temperature with a Wratten™ (Eastman Kodak Company) 2B filter for 1/50 second. The exposed samples were then processed using the known E-6 processing scheme. The average contrast was measured after conventional development for six minutes in the first developer (the black-and-white developer) followed by the remainder of the standard E-6 processing scheme. Contrast was measured as the change in density over log exposure between Density=0.3 and Density=1.6.

Table 1 shows the effect of the combination of grain size and interlayer on the average contrast between the lower scale of the curve (D=0.3) and the mid-point of the curve (D=1.6). In the table below, ECD represents the mean equivalent circular diameter of the grains contained in the slowest emulsions of the slow blue light-sensitive emulsion layer. IL 13 (the first layer of the invention) represents the amount of gelatin in mg/m$^2$ in layer 13 of Samples 1 through 11. As noted above, Samples 16 through 26 did not contain this layer. CLS is the colloidal silver layer. The term % Dev is the percent of deviation of the measured contrast from the aim contrast.

To provide optimum tone scale in normal reversal development time (i.e. 6 minutes in 1st developer), an average contrast of the blue light-sensitive, yellow dye-forming unit of between −1.17 and −1.29 is desired, with an average contrast of −1.23 being preferred. The range of contrasts from −1.17 to −1.29 represents a deviation of plus or minus 5% from the preferred contrast of −1.23. As can be seen from Table 1 only the inventive samples containing the first layer of the invention provide the desired contrast (within an acceptable deviation) when larger grain sizes are utilized as the slowest emulsion in the blue light-sensitive layer. Samples without the inventive interlayer between the blue light-sensitive layer and the colloidal silver layer only provide contrast values in the desired range if the blue light-sensitive color unit contains tabular grains in the slowest emulsion with a mean equivalent circular diameter of less than 0.35 microns.

The invention has been described in detail with particular reference to certain preferred embodiments thereof, but it will be understood that variations and modifications can be effected within the spirit and scope of the invention.

What is claimed is:

1. A color silver halide photographic element comprising a support having situated thereon a red light-sensitive, cyan dye-forming unit comprising a photosensitive silver halide emulsion layer and an image dye-forming coupler; a green light-sensitive, magenta dye-forming unit comprising a photosensitive silver halide emulsion layer and an image dye-forming coupler; and a blue light-sensitive, yellow dye-forming unit comprising a photosensitive silver halide emulsion layer and an image dye-forming coupler; the photographic element further comprising a first layer and a second layer, the second layer being a layer which provides a site of development for solution physical development; wherein at least one of the dye-forming units comprises two or more emulsion layers spectrally sensitized to the same region of the visible spectrum, but exhibiting different photographic sensitivities and wherein the first layer is positioned adjacent to the layer containing the slowest emulsion of said dye-forming unit and between the layer containing the slowest emulsion and the second layer;

TABLE 1

| Sample | ECD | IL 13 gel mg/m2 | CLS Ag mg/m2 | Contrast | Aim Contrast | % Dev | Within 5% Tolerance? | |
|---|---|---|---|---|---|---|---|---|
| 1 | 0.30 | 650 | 75 | −1.40 | −1.23 | 14% | no | comparison |
| 2 | 0.35 | 650 | 75 | −1.36 | −1.23 | 11% | no | comparison |
| 3 | 0.44 | 650 | 75 | −1.30 | −1.23 | 6% | no | comparison |
| 4 | 0.51 | 650 | 75 | −1.22 | −1.23 | 1% | yes | invention |
| 11 | 0.51 | 650 | 75 | −1.22 | −1.23 | 1% | yes | invention |
| 5 | 0.58 | 650 | 75 | −1.24 | −1.23 | 1% | yes | invenhon |
| 6 | 0.67 | 650 | 75 | −1.23 | −1.23 | 0% | yes | invention |
| 7 | 0.73 | 650 | 75 | −1.22 | −1.23 | 1% | yes | invention |
| 8 | 0.78 | 650 | 75 | −1.25 | −1.23 | 2% | yes | invention |
| 9 | 0.89 | 650 | 75 | −1.24 | −1.23 | 0% | yes | invention |
| 10 | 0.97 | 650 | 75 | −1.21 | −1.23 | 1% | yes | invention |
| 17 | 0.30 | 0 | 75 | −1.23 | −1.23 | 0% | yes | comparison |
| 18 | 0.35 | 0 | 75 | −1.21 | −1.23 | 1% | yes | comparison |
| 19 | 0.44 | 0 | 75 | −1.15 | −1.23 | 7% | no | comparison |
| 20 | 0.51 | 0 | 75 | −1.04 | −1.23 | 16% | no | comparison |
| 16 | 0.51 | 0 | 75 | −1.04 | −1.23 | 15% | no | comparison |
| 21 | 0.58 | 0 | 75 | −1.04 | −1.23 | 15% | no | comparison |
| 22 | 0.67 | 0 | 75 | −1.07 | −1.23 | 13% | no | comparison |
| 23 | 0.73 | 0 | 75 | −1.03 | −1.23 | 16% | no | comparison |
| 24 | 0.78 | 0 | 75 | −1.06 | −1.23 | 13% | no | comparison |
| 25 | 0.89 | 0 | 75 | −1.03 | −1.23 | 16% | no | comparison |
| 26 | 0.97 | 0 | 75 | −1.03 | −1.23 | 16% | no | comparison |

wherein in the layer containing the slowest emulsion of said dye-forming unit the slowest emulsion comprises tabular silver halide grains having a mean equivalent circular diameter of greater than 0.45 microns and less than 0.87 microns and wherein such grains account for at least 50% of the projected area of the grains in the emulsion layer when the layer contains a single emulsion and at least 25% of the projected area of the grains in the emulsion layer when the layer contains a blended emulsion.

2. The photographic element of claim 1 wherein the photographic element is a reversal element.

3. The photographic element of claim 1 wherein the second layer is a colloidal silver layer or a layer containing fogged grains.

4. The photographic element of claim 3 wherein the second layer is a colloidal silver layer.

5. The photographic element of claim 1 wherein the dye-forming units are situated on the support in the following order: the red light-sensitive, cyan dye-forming unit, the green light-sensitive magenta dye-forming unit; and the blue light-sensitive, yellow dye-forming unit wherein the dye-forming unit comprising two or more emulsion layers is the blue light-sensitive, yellow dye-forming unit and the first and second layers are positioned between the blue light-sensitive, yellow dye-forming unit and the green light-sensitive, magenta dye-forming unit.

6. The photographic element of claim 1 wherein the tabular silver halide grains have a mean Tabularity of greater than about 10.

7. The photographic element of claim 6 wherein the tabular silver halide grains have a mean Tabularity of greater than about 25.

8. The photographic element of claim 1 wherein the halide content of the tabular grains is at least 90 mole percent bromoiodide.

9. The photographic element of claim 1 wherein the first layer is free from colloidal silver.

10. The photographic element of claim 1 wherein the first layer comprises an oxidized developing agent scavenger.

11. The photographic element of claim 1 wherein the first layer contains between 260 and 2200 mg of gelatin/$m^2$.

12. The photographic element of claim 2 wherein the second layer is a colloidal silver layer or a layer containing fogged grains; wherein the first layer contains between 260 and 2200 mg gelatin/$m^2$; wherein the tabular silver halide grains have a mean Tabularity of greater than about 10 and the halide content of the tabular grains is at least 90 mole percent.

13. The photographic element of claim 12 wherein the first layer is free from colloidal silver.

14. The photographic element of claim 12 wherein the first layer comprises an oxidized developing agent scavenger.

15. A silver halide reversal color photographic element comprising a support having situated thereon in order from the support a red light-sensitive, cyan dye-forming unit comprising a photosensitive silver halide emulsion layer and a cyan image dye-forming coupler; a green light-sensitive, magenta dye-forming unit comprising a photosensitive silver halide emulsion layer and a magenta image dye-forming coupler; and a blue light-sensitive, yellow dye-forming unit comprising two or more emulsion layers spectrally sensitized to the same region of the visible spectrum, but exhibiting different photographic sensitivities, each such emulsion layer containing a yellow image dye-forming coupler; the photographic element further comprising between the blue light-sensitive, yellow dye-forming unit and the green light-sensitive, magenta dye-forming unit a first layer and a second layer, the second layer being a colloidal silver layer or a layer containing fogged grains; wherein the first layer is positioned adjacent to the layer containing the slowest emulsion of the blue light-sensitive, yellow dye-forming unit and between the layer containing the slowest emulsion and the second layer; wherein in the layer containing the slowest emulsion of the blue light-sensitive yellow dye-forming unit the slowest emulsion comprises tabular silver halide grains having a mean equivalent circular diameter of greater than 0.45 microns and less than 0.87 microns and a mean Tabularity of greater than about 10 and wherein such grains account for at least 50% of the projected area of the grains in the emulsion layer when the layer contains a single emulsion and at least 25% of the projected area of the grains in the emulsion layer when the layer contains a blended emulsion.

16. The photographic element of claim 15 wherein the tabular silver halide grains have a mean Tabularity of greater than about 25.

17. The photographic element of claim 15 wherein the halide content of the tabular grains is at least 90 mole percent bromoiodide.

18. The photographic element of claim 15 wherein the second layer is a colloidal silver layer.

19. The photographic element of claim 15 wherein the first layer contains between 260 and 2200 mg gelatin/$m^2$.

20. The photographic element of claim 15 wherein the first layer is free from colloidal silver.

21. The photographic element of claim 15 wherein the first layer comprises an oxidized developing agent scavenger.

22. A silver halide reversal color photographic element comprising a support having situated thereon in order from the support a red light-sensitive, cyan dye-forming unit comprising a photosensitive silver halide emulsion layer and a cyan image dye-forming coupler; a green light-sensitive, magenta dye-forming unit comprising a photosensitive silver halide emulsion layer and a magenta image dye-forming coupler; and a blue light-sensitive, yellow dye-forming unit comprising two or more emulsion layers spectrally sensitized to the same region of the visible spectrum, but exhibiting different photographic sensitivities, each such emulsion layer containing a yellow image dye-forming coupler; the photographic element further comprising between the blue light-sensitive, yellow dye-forming unit and the green light-sensitive, magenta dye-forming unit a first layer and a second layer, the second layer being a colloidal silver layer or a layer containing fogged grains; wherein the first layer is positioned adjacent to the layer containing the slowest emulsion of the blue light-sensitive, yellow dye-forming unit and between the layer containing the slowest emulsion and the second layer and wherein the first layer contains between 260 and 2200 mg gelatin/$m^2$ and is free from colloidal silver; wherein in the layer containing the slowest emulsion of the blue light-sensitive, yellow dye-forming unit the slowest emulsion comprises tabular silver halide grains with a halide content of at least 90 mole percent bromoiodide and having a mean equivalent circular diameter of greater than 0.45 microns and less than 0.87 microns and a mean Tabularity of greater than about 25 and wherein such grains account for at least 50% of the projected area of the grains in the emulsion layer when the layer contains a single emulsion and at least 25% of the projected area of the grains in the emulsion layer when the layer contains a blended emulsion.

23. The photographic element of claim 22 wherein the first layer comprises an oxidized developing agent scavenger.

* * * * *